US010077532B2

(12) United States Patent
Irion

(10) Patent No.: US 10,077,532 B2
(45) Date of Patent: Sep. 18, 2018

(54) RAIL PLATE DROPPING APPARATUS

(71) Applicant: NORDCO INC., Oak Creek, WI (US)

(72) Inventor: Allan Irion, Milwaukee, WI (US)

(73) Assignee: NORDCO INC., Oak Creek, WI (US)

( * ) Notice: Subject to any disclaimer, the term of this patent is extended or adjusted under 35 U.S.C. 154(b) by 189 days.

(21) Appl. No.: 15/152,251

(22) Filed: May 11, 2016

(65) Prior Publication Data

US 2017/0328014 A1 Nov. 16, 2017

(51) Int. Cl.
*E01B 29/24* (2006.01)

(52) U.S. Cl.
CPC ..... *E01B 29/24* (2013.01)

(58) Field of Classification Search
CPC ..... E01B 29/24
USPC ..... 104/16
See application file for complete search history.

(56) References Cited

U.S. PATENT DOCUMENTS 4,942,822 A * 7/1990 Cotic ..... E01B 29/32 104/16
5,655,455 A * 8/1997 Smith ..... E01B 29/32 104/16
6,595,140 B1 * 7/2003 Madison ..... E01B 29/32 104/16
6,863,717 B2 * 3/2005 Johnsen ..... E01B 29/32 104/9
7,497,166 B2 * 3/2009 Fuerst ..... E01B 29/32 104/16
7,647,871 B2 * 1/2010 Claas ..... E01B 13/02 104/17.2
7,658,152 B2 * 2/2010 Brenny ..... E01B 29/32 104/16
8,171,855 B2 * 5/2012 Noll ..... E01B 29/32 104/16
8,220,397 B2 * 7/2012 Sperling ..... E01B 29/32 104/16
8,468,948 B2 * 6/2013 Delmonico ..... E01B 29/32 104/16
2016/0153151 A1 * 6/2016 Irion ..... E01B 29/10 104/9
2017/0328014 A1 * 11/2017 Irion ..... E01B 29/24

* cited by examiner

*Primary Examiner* — Jason C Smith
(74) *Attorney, Agent, or Firm* — Greer, Burns & Crain, Ltd.

(57) ABSTRACT

A rail plate dropping apparatus is provided, including a plate magazine having an upper end and a lower end and constructed and arranged for retaining at least one rail tie plate, a locating portion connected at the upper end and constructed and arranged for reciprocally positioning the magazine between a raised, travel position and a lowered work position, and an ejector mounted in operational relationship relative to the lower end of the magazine and configured for ejecting the plates sequentially from the magazine.

13 Claims, 7 Drawing Sheets

RAIL PLATE DROPPING APPARATUS

BACKGROUND

The present invention relates generally to railroad maintenance machinery, and more specifically to equipment used for handling and replacing rail tie plates during the reconditioning of railroad track.

During conventional railroad track maintenance, spikes are removed and rail plates removed from the ties. The rail is lifted, then the ties are withdrawn. In some cases, the tie plates remain embedded in the ties and must be manually removed. While the rail is lifted, a new tie is inserted beneath the rail. Then, the tie plates are replaced in position between a foot of the rail and an upper surface of the tie. Once the tie is replaced and the tie plate repositioned, fasteners such as spikes are inserted into the tie to secure the tie plate in position. Next, rail anchors are applied as desired at edges of the tie plate.

A suitable tie exchange machine is disclosed in commonly-assigned U.S. Pat. No. 6,463,858 which is incorporated by reference. Also, conventional tie plate placement devices are disclosed in U.S. Pat. No. 7,497,166 and U.S. Pat. No. 6,863,717 also incorporated by reference.

It is desirable for the operations of railroad track reconditioning, and specifically rail tie replacement, to be automated as much as possible. Manual lifting and placement of rail tie plates is laborious. Thus, there is a need for an automated tie plate handling apparatus.

SUMMARY

The above-listed needs are met or exceeded by the present rail plate dropping apparatus, which features a movable plate dispenser including a connection to a conventional rail maintenance machine so that the dispenser can be reciprocally moved vertically between a raised, travel position, and a lowered work position, and a magazine for storing a plurality of rail plates. In the lowered work position, a plate ejector mechanism ejects the plates sequentially from the magazine under operator control. The present rail plate dropping apparatus is useful during track repair or reconditioning, when a rail plate is broken or missing. In such situations, the present rail plate dropping apparatus is used to drop a plate upon a designated rail tie. Preferably, the plate is dropped in a "staging" position on the tie between the rails. Next, a supplemental rail plate handling device, such as is disclosed in commonly-assigned U.S. Pat. No. 9,777,439 incorporated by reference, grasps the tie plate and inserts it properly under the designated, raised rail.

More specifically, the present invention provides a rail plate dropping apparatus, including a plate magazine having an upper end and a lower end and constructed and arranged for retaining at least one rail tie plate, a locating portion connected at the upper end and constructed and arranged for reciprocally positioning the magazine between a raised, travel position and a lowered work position, and an ejector mounted in operational relationship relative to the lower end of the magazine and configured for ejecting the plates sequentially from the magazine.

In another embodiment, a rail plate dropping apparatus is provided for mounting on a rail maintenance machine, and includes a plate magazine having an upper end and a lower end and constructed and arranged for retaining a plurality of vertically stacked rail tie plates. A locating portion is connected to the magazine and is constructed and arranged for reciprocally positioning the magazine between a raised, travel position and a lowered work position. An ejector is mounted in operational relationship relative to the lower end of the magazine and having a linearly reciprocating pusher constructed and arranged for ejecting the plates sequentially from a plate outlet at the magazine, the pusher operating in the same direction as the railroad track.

DETAILED DESCRIPTION

Figure 1:
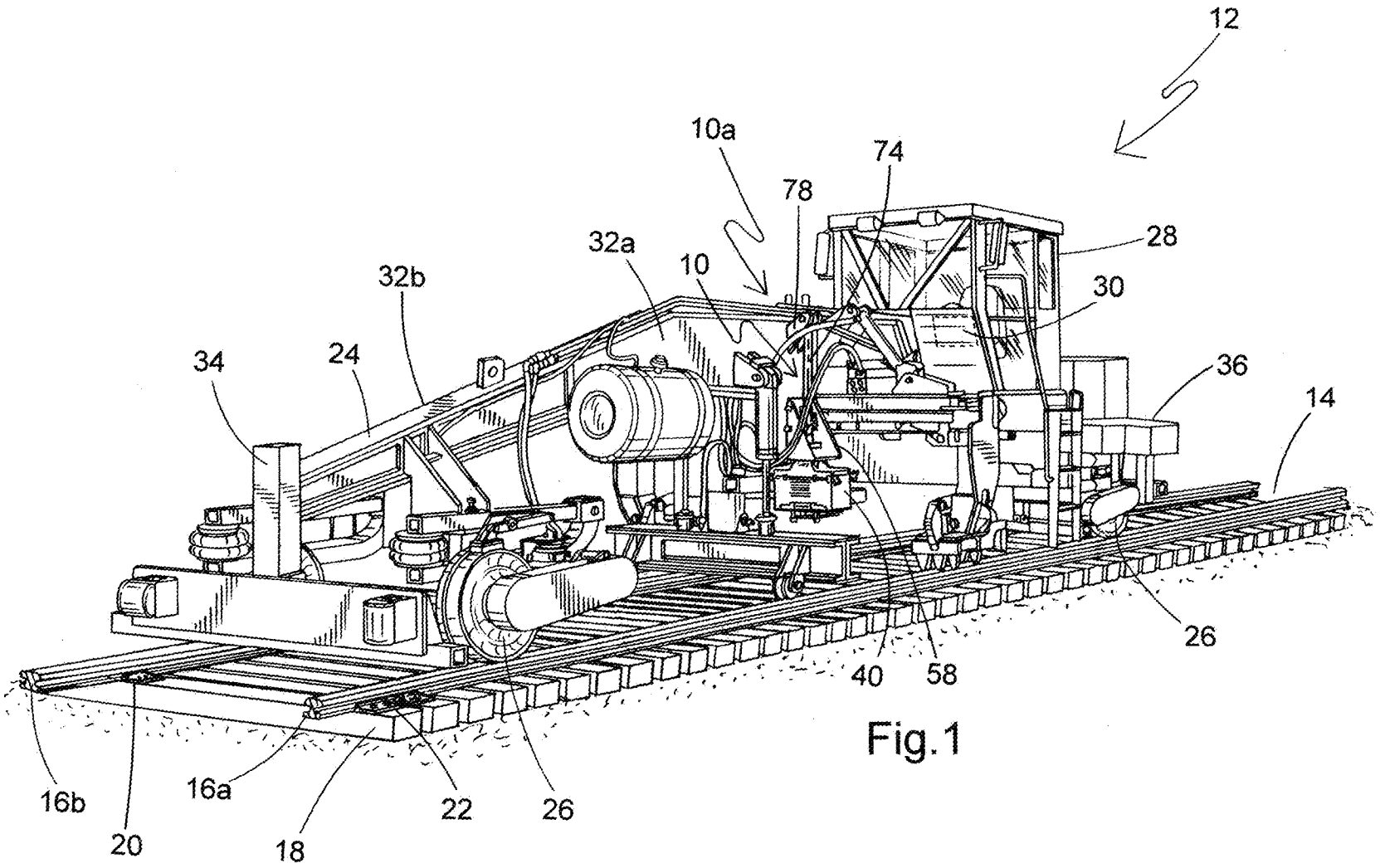
FIG. 1 is a perspective view of a rail maintenance machine equipped with the present plate dropper apparatus.
Figure 3:
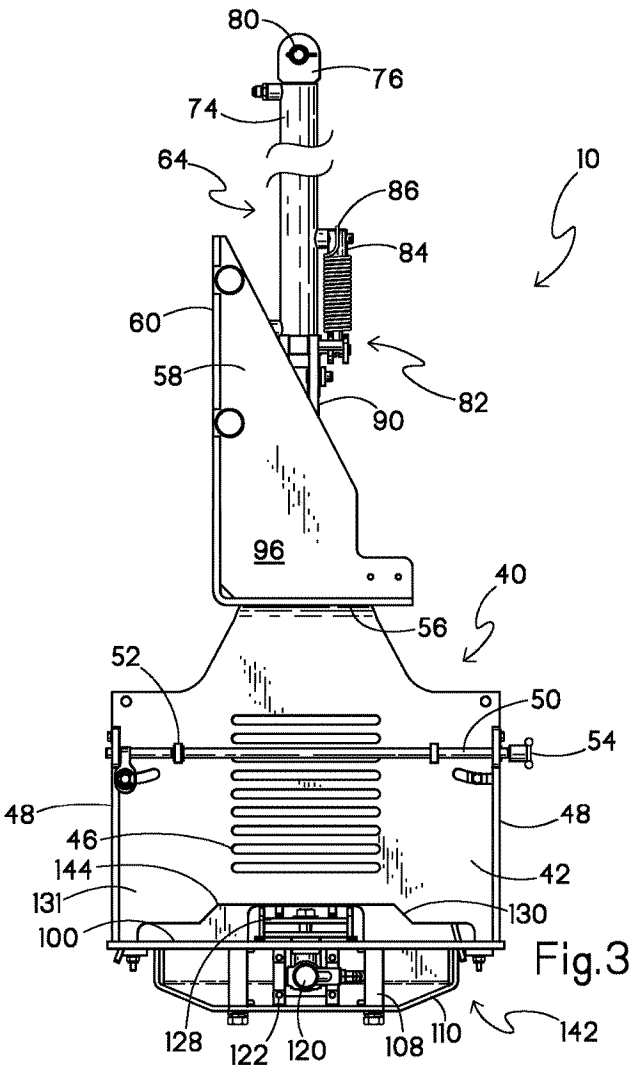
FIG. 3 is a front elevation of the plate dropper apparatus of FIG. 2.

Referring now to FIG. 1, the present tie plate dropping apparatus, generally designated 10, is preferably mounted a rail maintenance generally designated 12. The machine 12 is disclosed in greater detail in U.S. Pat. No. 6,463,858, incorporated by reference, and is preferably designed to be self-propelled on a railroad track 14. It is also contemplated, however, that the apparatus 10 may be configured to be propelled along the track 14 by another vehicle.

The track 14 includes first and second rails 16*a*, and 16*b*, respectively, and a plurality of ties 18. As is known in the art, the rails 16*a*, 16*b*, are located upon the ties 18 using tie plates 20, which are secured to the tie using fasteners 22 such as cut spikes, lag screws, or the like. Furthermore, the machine 12 includes a frame 24 supported on a plurality of wheels 26 such that the frame can be driven along the rails 16*a*, 16*b*. The frame 24 supports a source of motive power such as an internal combustion engine (not shown), which propels the machine 12 and also powers a fluid power system (not shown), which in the preferred embodiment is hydraulic, and an operator's cab 28 housing a control system 30.

It will be evident that the frame 24 has a first side 32*a* and a second side 32*b*, each side corresponding to one of the rails 16*a*, 16*b*. In addition, the frame 24 has a first or front end 34 and a second or rear end 36. The operator's cab 28 is situated nearer to the rear end 36 of the machine 12 and enables the operator to observe and control repair operations on either rail 16*a* or 16*b*.

It is contemplated that the present rail maintenance machine 12 is provided in a pair of the present plate dropping apparatuses 10, so that one such apparatus is secured to each of the sides 32*a*, 32*b* of the frame 24 for accessing the tie plates 20 on each of the rails 16*a*, 16*b* as the machine travels along the track 14.

Referring now to FIGS. 2-6, the present plate dropping apparatus 10 includes a plate dropping magazine 40 with a front and rear wall, 42, 44 each having a plurality of vertically spaced indicator slots 46, and a pair of sidewalls 48. In the preferred embodiment, the sidewalls 48 are shorter in lateral width than the front and rear walls, 42, 44, to generally correspond to the dimensions of conventional rail tie plates 20, however these dimensions are variable depending on the application. For easy loading of the magazine 40 with rail tie plates 20, the sidewalls 48 are detachably secured to the front and rear walls 42, 44 using threaded rods 50 secured to the front and rear walls by passing through eyelets 52 fixed to the front and rear walls, and corresponding holes in the sidewalls. The sidewalls 48 are held in place using knurled threaded caps 54 for facilitating operator manipulation.

Figure 5:
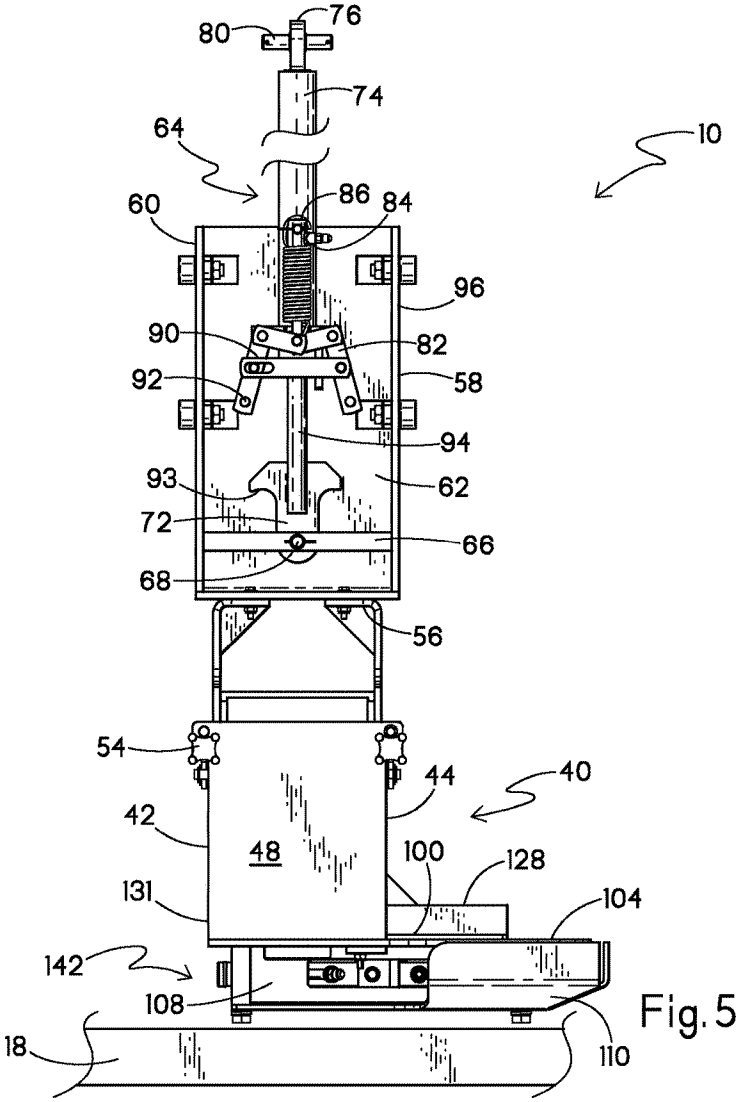
FIG. 5 is a left side view of the present plate dropper apparatus.
Figure 4:
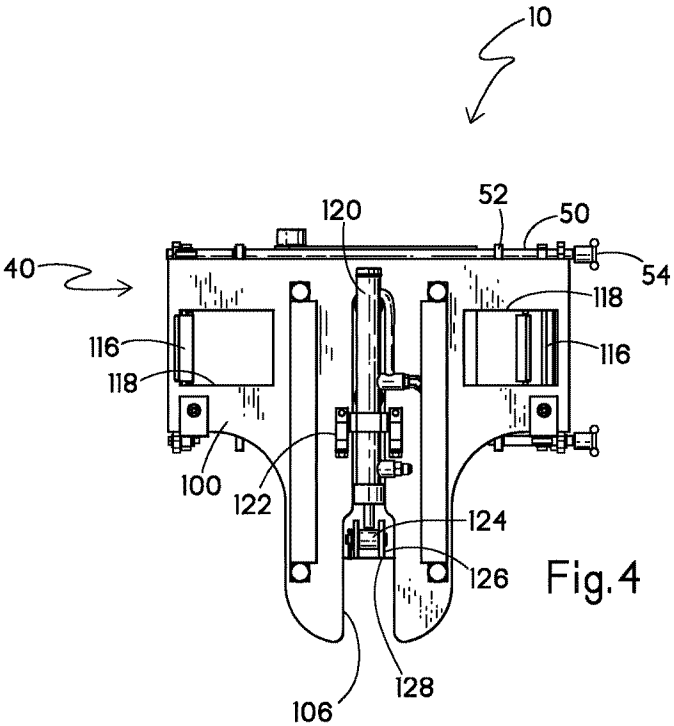
FIG. 4 is a bottom view of the present plate dropper apparatus.
Figure 7:
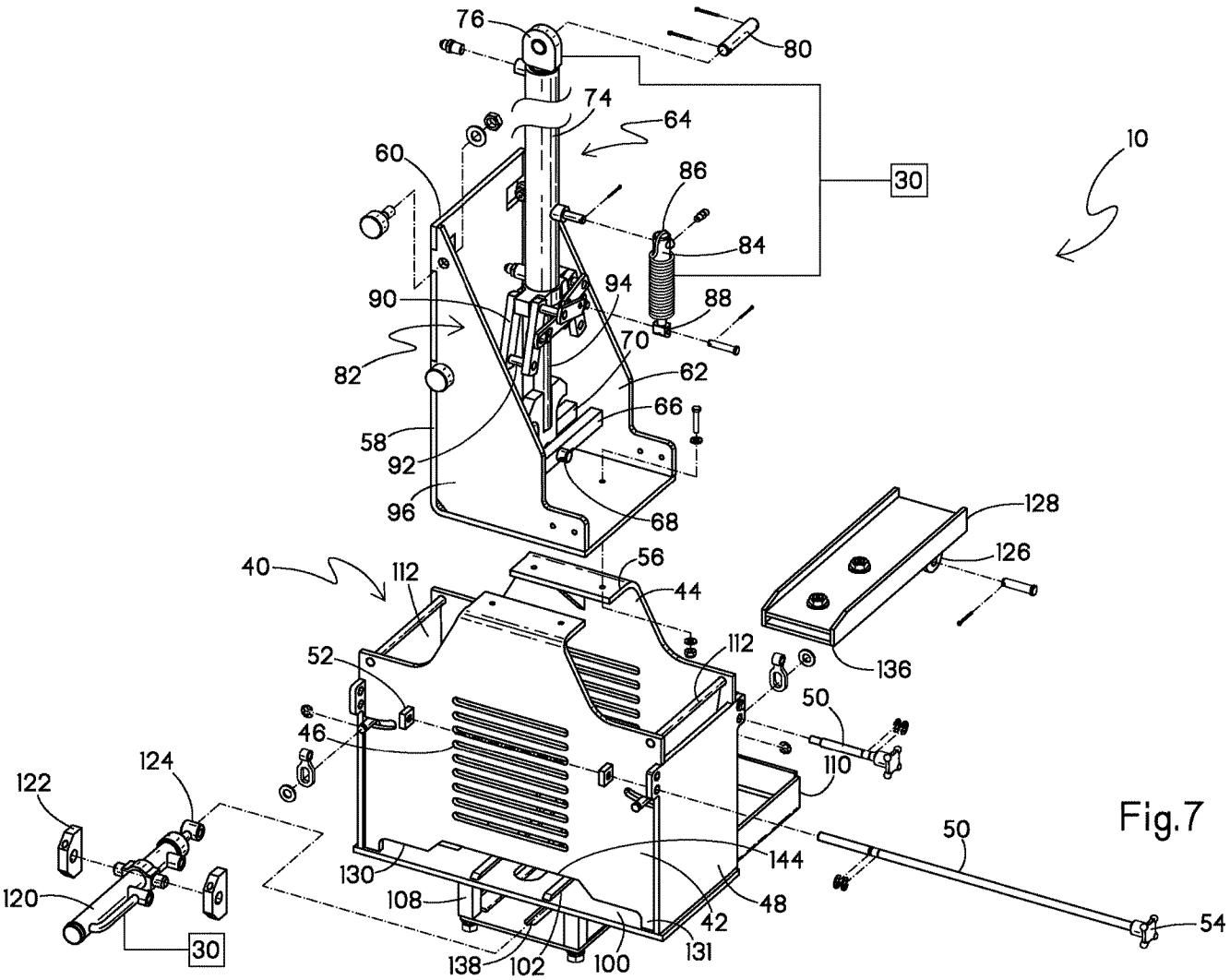
FIG. 7 is an exploded perspective view of the present plate dropping apparatus.
Figure 9:
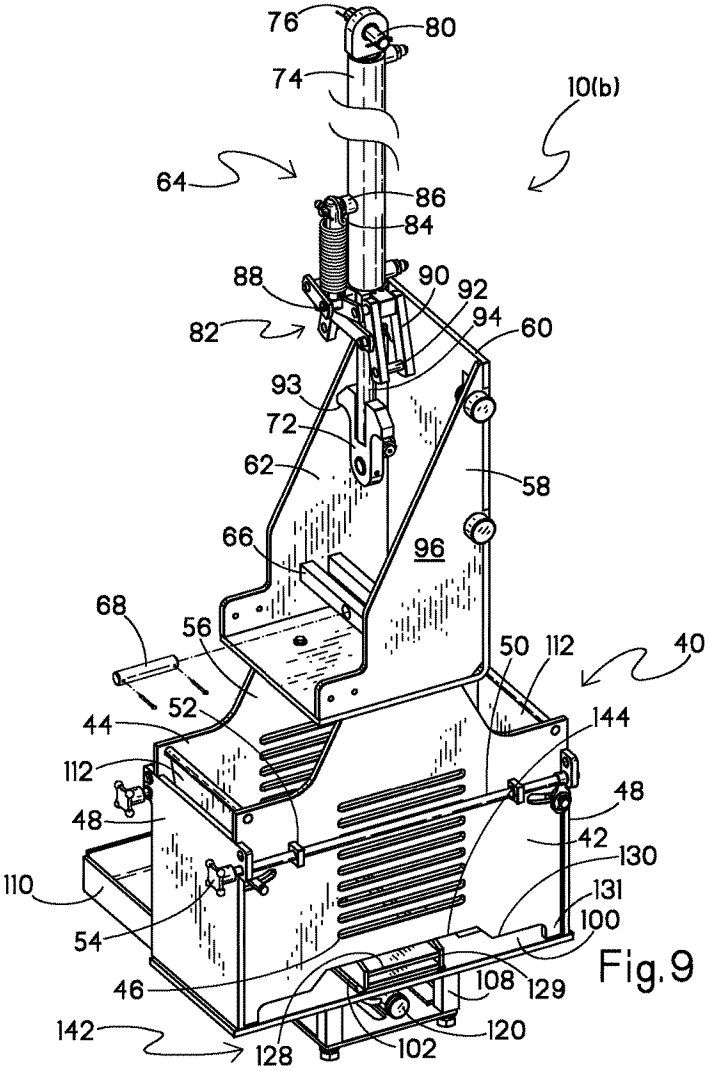
FIG. 9 is a partially exploded view of the present apparatus for use on the left side of the machine of FIG. 1.

An upper end 56 of the magazine 40 is secured, as by threaded fasteners, welding or the like, to a mounting bracket 58 having an outer bracket housing 60 defining a space 62 constructed and arranged for enclosing a locating portion 64. Also included in the bracket housing 60 is a pair of spaced, parallel bracket bars 66 each having a mounting bore for receiving a mounting pin 68, and defining a gap 70 for receiving a lower end 72 of the locating portion (FIGS. 5, 7, 9). It will be seen that the mounting bracket 58 and the magazine 40 pivot relative to the locating portion 64 about the mounting pin 68.

The locating portion 64 is connected to the upper end 56 of the magazine 40 through the mounting bracket 58 and is constructed and arranged for reciprocally positioning the magazine between a raised, travel position (FIG. 1) and a lowered work position (FIG. 5) relative to the machine 12. A major component of the locating portion 64 is a fluid power cylinder 74, preferably a hydraulic cylinder connected preferably at the lower or rod end 72 to the gap 70 between the mounting bars 68 and receiving the mounting pin 68. At the opposite and preferably blind end 76, the cylinder 74 is connected to a clevis style frame bracket 78 on the frame 24 of the machine 12 using a frame pin 80.

Another feature of the locating portion 64 is a locking mechanism 82 configured for retaining the magazine 40 in the travel position. More specifically, the locking mechanism 82 includes a fluid powered locking cylinder 84 connected at one end 86 to the cylinder 74 and at the opposite end 88 to a locking linkage 90 having clamp elements 92, preferably pins, that engage hooks 93 on a rod 94 of the cylinder 74 (FIGS. 5 and 9) to prevent its linear extension. When the locking cylinder 84 is powered, the linkage 90 is opened, and the pins 92 are disengaged from the hooks 93. In this position, the rod 94 is free to move vertically. When power is removed from the locking cylinder 84, the spring return closes the pins 92 to be engaged by the hooks. In the preferred embodiment, the locking cylinder 84 has a spring return, however, double acting cylinders are also contemplated, as are known in the art. The locking cylinder 84, as well as the cylinder 74 are under operator control via the control system 30.

It will be seen that the outer bracket 60 and the space 62 includes generally triangular bracket walls 96 that protect the locating portion 64, and particularly the locking linkage 90, while at the same time providing operator access to these components for maintenance in the field as needed. The bracket walls 96 also support the mounting bars 66.

Figure 6:
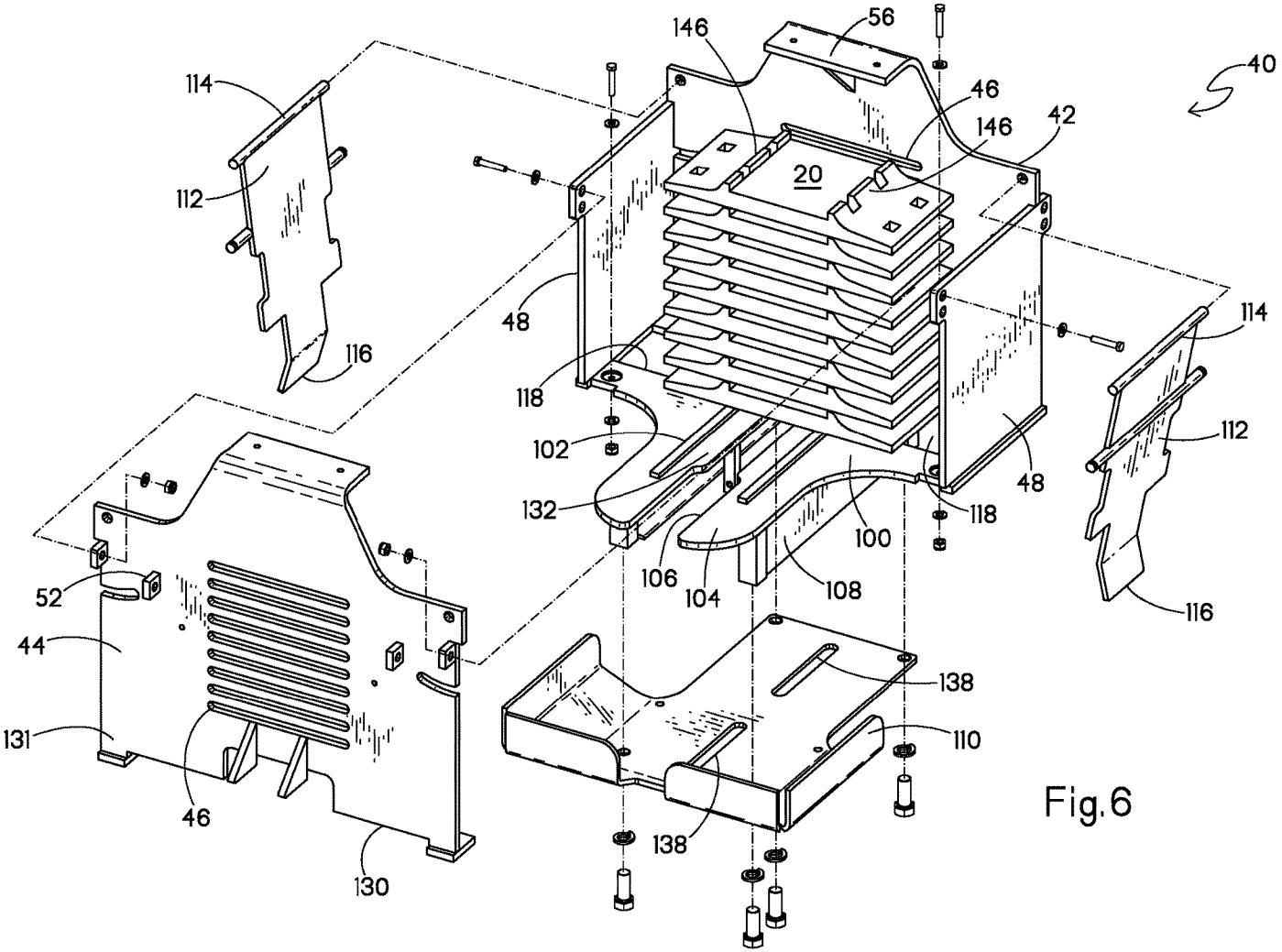
FIG. 6 is an exploded perspective view of the plate magazine of the present plate dropping apparatus.

Referring now to FIGS. 2-6 and especially to FIG. 6, the magazine 40 is dimensioned for retaining a plurality, and preferably 8 to 10 rail tie plates 20, the lowermost of which will rest on a magazine floor 100. The floor 100 includes spaced, parallel guide rails 102 for facilitating sliding action of a pusher, described below, along the floor. The floor 100 also includes a tongue portion 104 extending past the front wall 42, and an open groove 106 located between the rails. Depending from the tongue portion 104 is a pair of spaced parallel tongue ribs 108 to which is attached a pusher housing 110 in vertically spaced relationship to the floor 100. Also enclosed within the magazine 40 is at least one, and preferably a pair of rail plate locators 112 pivotally secured at upper ends 114 to the front and rear magazine walls 42, 44, and having tips 116 moving in openings 118 in the floor 100 for facilitating the stacking of plates 20.

Figure 8:
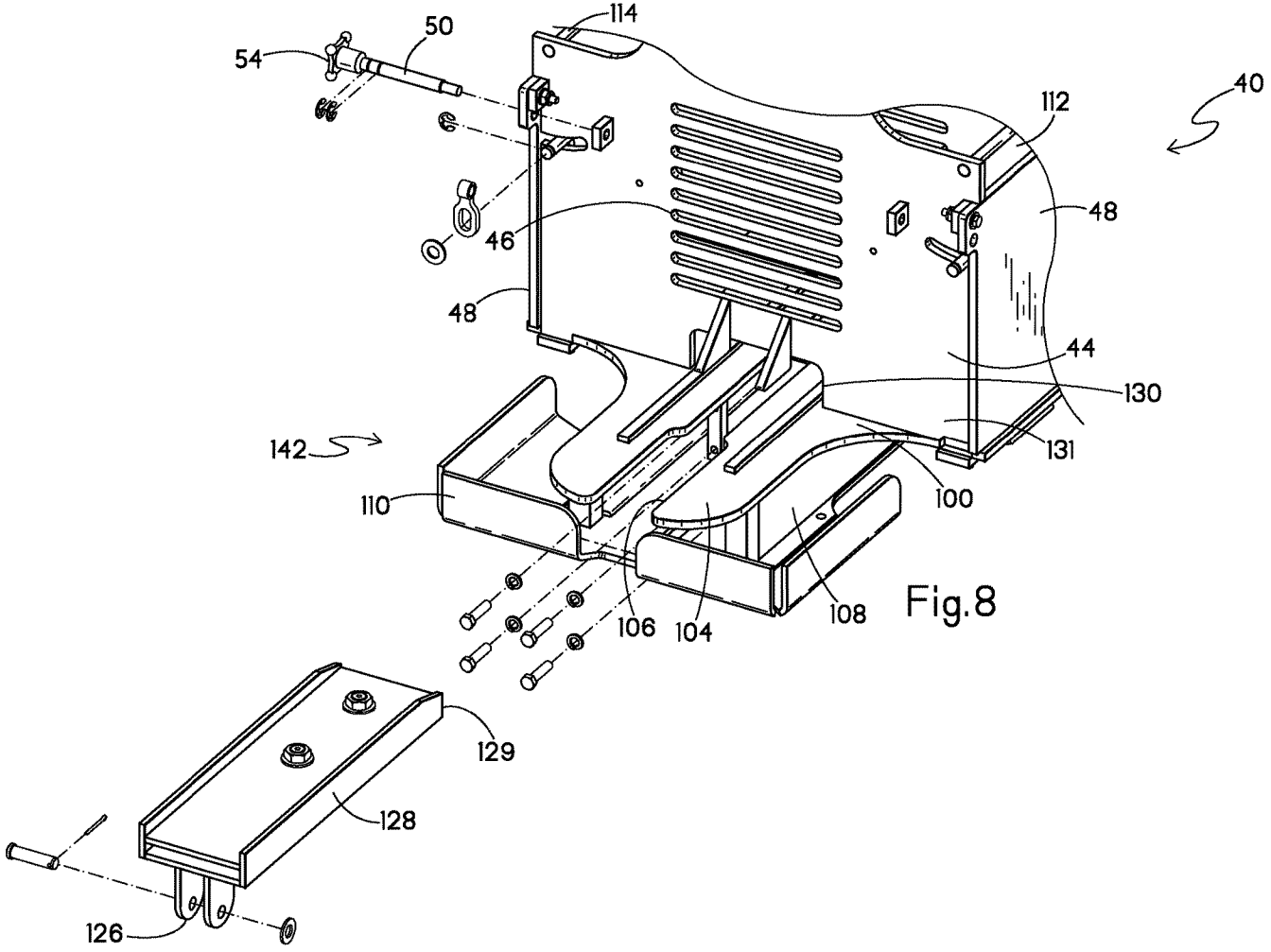
FIG. 8 is a fragmentary rear perspective view of the present apparatus showing the pusher in exploded perspective view.
Figure 10:
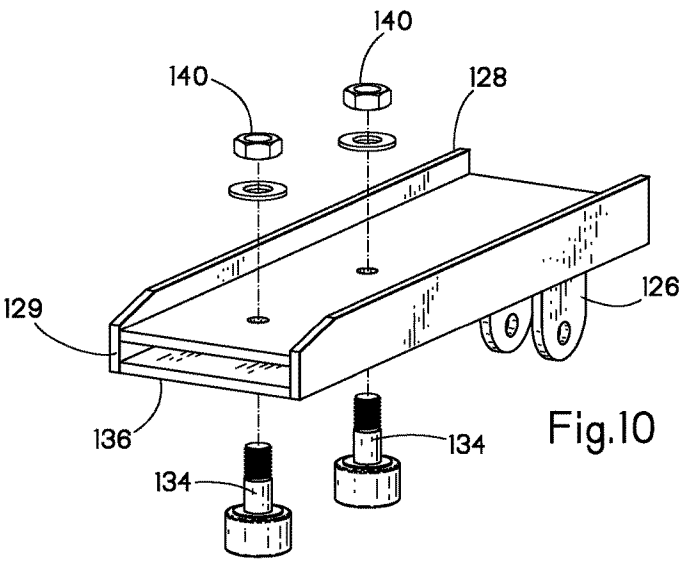
FIG. 10 is an exploded perspective view of the present plate pusher.

Referring now to FIGS. 4-10, the pusher housing 110 encloses a fluid powered pusher cylinder 120 (FIG. 4), mounted below the floor 100 by brackets 122 or the like and being in linear alignment with the groove 106. In the preferred embodiment, the pusher cylinder 120 is double acting, however a single acting, spring return cylinder is contemplated. A rod end 124 of the cylinder 120 is connected to a depending clevis bracket 126 of a pusher 128 (FIGS. 7, 8, 10). It will be seen that the clevis bracket 126 is located nearer an opposite end of the pusher 128 from a plate engaging end 129. The pusher 128 reciprocates linearly along the floor 100 between a retracted position (FIG. 5), in which a next lowermost tie plate falls into position on the floor 100 and an extended position (FIG. 9), in which the plate engaging end 129 of the pusher has pushed the lowermost plate 20 from the magazine 40 through a plate outlet 130 in the front wall 42 and at a lower end 131 of the magazine. A similar outlet 130 on the rear wall 44 accommodates the reciprocal movement of the pusher 128.

The guide rails 102 define a track 132 (FIG. 6) that slidingly receives the pusher 128. In addition, the pusher 128 is guided relative to the pusher housing by locating pins 134 (FIG. 10) depending from an underside 136 of the pusher, which slidingly engage slots 138 (FIG. 6) in the pusher housing 110. Suitable fasteners 140 such as nuts and lock washers or the like retain the locating pins 134 in position on the pusher 128 (FIG. 10). Thus, as seen in FIGS. 5 and 8, the tongue portion 104 of the floor 100 supports the pusher 128 and accommodates its motion in the retracted position.

The pusher housing 110, the pusher 128, the pusher cylinder 120 and the plate outlet 130 at the lower end 131 of the magazine 40 will be generally referred to as a plate ejector, or alternately, an ejector 142.

Figure 2:
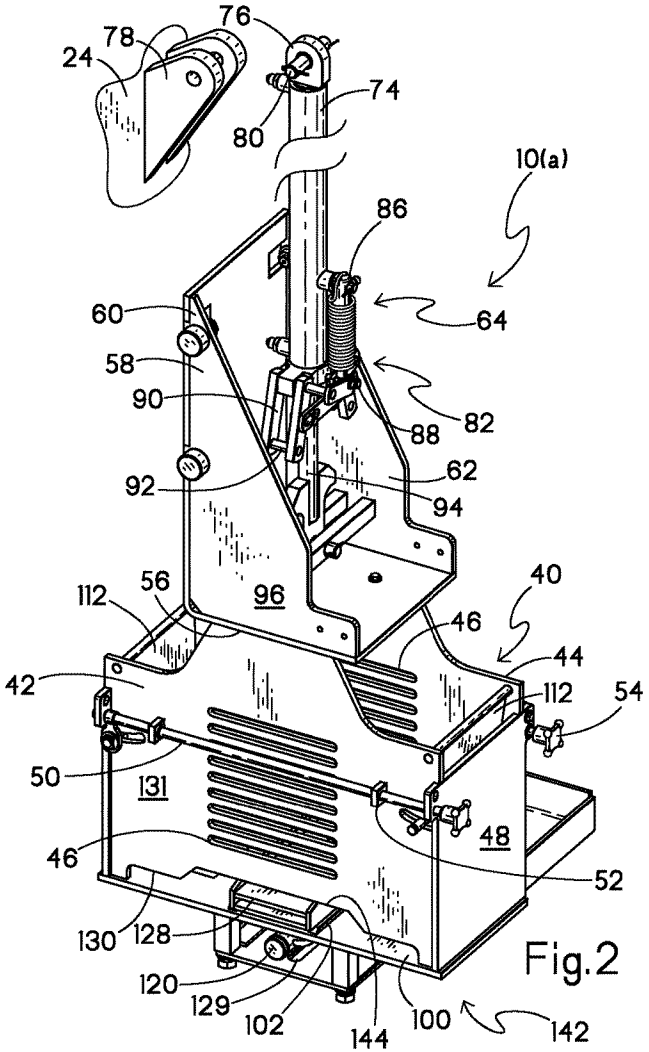
FIG. 2 is a front perspective view of a first side version of the present plate dropper apparatus.

Referring now to FIGS. 2 and 9, it is preferred that a pair of plate dropping apparatuses, here labeled 10*a* and 10*b*, are provided to the rail maintenance machine 12 so that rail tie plates 20 are more easily dropped upon the designated tie 18 more closely adjacent the designated rail 16. As such, the present apparatus 10*a*, 10*b* is provided in "right" and "left" side versions, each having the same components and differentiated mainly by the orientation of the mounting bracket 58, and more specifically by the orientation of the triangular bracket walls 96.

It will be seen that the open side of the brackets 58 face outwardly on each side of the machine frame 24. However, in both versions 10*a*, 10*b*, the rail tie plates 20 are preferably ejected from the plate outlet 130 facing towards the front end 34 of the machine frame 24. In other words, the plates 20 are ejected from the outlet 130 in the direction of the track 14, or in other words along a longitudinal axis of the track. A reverse orientation of the apparatus 10*a*, 10*b* on the frame 24 is also contemplated, depending on the application. Also, in the plate ejector 142, the pusher 128 reciprocates along a linear axis that is perpendicular to the axis of reciprocation of the locating portion 64. Another feature of the present plate dropping apparatus 10 is that the plate outlet 130 is dimensioned to accommodate the passage of the rail plate 20. As such, the outlet 130 has a taller central portion 144 for facilitating passage of the generally vertically projecting rail tie plate shoulders 146 (FIG. 6).

Referring now to FIG. 7, as is well known in the railway maintenance machinery art, the operator control system 30, with the operator interface located in the cab 28, is connected to the cylinder 74, the locking mechanism 82, and the pusher cylinder 120 using electro-mechanical or electro-hydraulic control systems well known in the art so that the operator, can selectively activate the plate dropping apparatus 10 for automatically dropping a rail tie plate 20 on the track 14 where needed.

While a particular embodiment of the present rail plate dropping apparatus has been described herein, it will be appreciated by those skilled in the art that changes and modifications may be made thereto without departing from the invention in its broader aspects and as set forth in the following claims.

The invention claimed is:

1. A rail plate dropping apparatus, comprising:

a plate magazine having an upper end and a lower end and constructed and arranged for retaining at least one rail tie plate;

a locating portion connected to said magazine and constructed and arranged for reciprocally positioning said magazine between a raised, travel position and a lowered work position;

an ejector mounted in operational relationship relative to said lower end of said magazine and configured for ejecting the plates sequentially from said magazine; and said locating portion includes a fluid power cylinder connected to said magazine and constructed and arranged for mounting to a railroad maintenance machine.

2. The apparatus of claim 1 wherein said magazine is provided with a plurality of indicator slots on at least one sidewall.

3. The apparatus of claim 1 wherein said fluid power cylinder is equipped with a locking mechanism for selectively retaining said magazine in the travel position.

4. The apparatus of claim 1 wherein said ejector includes a reciprocating pusher mounted in operational relationship to said lower end of said magazine to sequentially engage the plates and eject them from an outlet at said lower end of said magazine.

5. The apparatus of claim 4 wherein said ejector further includes a fluid powered cylinder mounted at one end to a floor of said magazine and at an opposite end to said pusher.

6. The apparatus of claim 5 wherein said pusher reciprocates relative to said magazine through an opening in an opposite wall relative to said outlet.

7. The apparatus of claim 5 wherein said pusher reciprocates along an axis perpendicular to said reciprocating action provided by said locator portion.

8. The apparatus of claim 4 wherein said magazine has a floor provided with a track for facilitating the sliding action of said pusher.

9. The apparatus of claim 1 further including a mounting bracket at least partially surrounding said locator portion and connected to said magazine.

10. The apparatus of claim 9 further including a locking mechanism located within a space defined by said bracket for controlling movement of said locating portion.

11. The apparatus of claim 1, wherein said ejector mounted in operational relationship relative to said lower end of said magazine has a linearly reciprocating pusher constructed and arranged for ejecting the plates sequentially from a plate outlet at said magazine, said pusher operating in the same direction as the railroad track.

12. A rail plate dropping apparatus, comprising:

a plate magazine having an upper end and a lower end and constructed and arranged for retaining at least one rail tie plate;

a locating portion connected to said magazine and constructed and arranged for reciprocally positioning said magazine between a raised, travel position and a lowered work position;

an ejector mounted in operational relationship relative to said lower end of said magazine and configured for ejecting the plates sequentially from said magazine; and a mounting bracket at least partially surrounding said locator portion and connected to said magazine.

13. The apparatus of claim 12 further including a locking mechanism located within a space defined by said bracket for controlling movement of said locating portion.

* * * * *